US006369342B1

(12) United States Patent
Buck

(10) Patent No.: US 6,369,342 B1
(45) Date of Patent: Apr. 9, 2002

(54) METHOD OF MANUFACTURE FOR A METAL PALLET

(76) Inventor: James R. Buck, 4216 Old Mill Cove Trail West, Jacksonville, FL (US) 32277

( * ) Notice: Subject to any disclaimer, the term of this patent is extended or adjusted under 35 U.S.C. 154(b) by 0 days.

(21) Appl. No.: 09/577,727

(22) Filed: May 23, 2000

Related U.S. Application Data

(63) Continuation-in-part of application No. 09/281,516, filed on Mar. 30, 1999, now Pat. No. 6,095,292.

(51) Int. Cl.[7] ..... B23K 11/00
(52) U.S. Cl. ..... 219/58; 108/57.14
(58) Field of Search ..... 219/58, 56, 117.1; 108/57.14

(56) References Cited

U.S. PATENT DOCUMENTS

| | | | | | |
|---|---|---|---|---|---|
| 1,973,113 | A | * | 9/1934 | Schultz | 219/58 |
| 2,231,450 | A | * | 2/1941 | Lachman | 219/58 |
| 2,437,186 | A | * | 3/1948 | Collins | 219/58 |
| 4,262,184 | A | * | 4/1981 | Cerutti | 219/58 |
| 5,416,288 | A | * | 5/1995 | Widmer | 219/56 |

* cited by examiner

*Primary Examiner*—Clifford C. Shaw
(74) *Attorney, Agent, or Firm*—Thomas C. Saitta

(57) ABSTRACT

A method of manufacture of a metal pallet having a deck member formed as a grate or grid by the perpendicular intersection of plural rod members with flat bar members positioned on edge, where the rod members are embedded within the flat bar members by pressure resistance welding such that the upper surface defined by the rod members is even with the upper surface defined by the flat bar members.

12 Claims, 3 Drawing Sheets

METHOD OF MANUFACTURE FOR A METAL PALLET

This application is a continuation-in-part of U.S. application Ser. No. 09/281,516, filed Mar. 30, 1999, now U.S. Pat. No. 6,095,292.

BACKGROUND OF THE INVENTION

This invention relates generally to the field of methods of manufacture pallets used to support heavy items or equipment, or large numbers of discrete items such as bags or boxes, for movement by a handtruck or forklift, and more particularly to such pallets made of metal rather than wood. Even more particularly, the invention relates to the manufacture of metal pallets where the deck member is formed by intersecting members in a grid or grate pattern, and where the technique of pressure resistance welding is utilized.

Pallets for supporting objects are well known. The most common pallet is wooden and comprises two planar deck members composed of sheets or individual slats, the deck members being separated by upright supports to allow for insertion of the tines of a handtruck or forklift between the deck members so that the pallet can be raised and moved to a different location. Another common pallet construction utilizes a single deck member supported by legs, the legs properly spaced to allow for insertion of the tines beneath the deck member. Wooden pallets, while cheap to manufacture, have a limited life under the best circumstances, are readily susceptible to damage and decay, are difficult to dispose of or recycle, and have limited support capacity To solve these problems, metal pallets have been developed—the metal material providing longer life, less likelihood of damage and degradation, and increased support capacity. A problem with metal pallets is that the pallet itself is heavier and the materials and methods of construction are costlier than for a wooden pallet. To address the weight issue, metal pallets have been developed where the deck member is formed by intersecting bars or rods to define or grid or grate as the upper surface rather than having a solid or extended upper surface to bear the goods. Examples of these pallets are seen in U.S. Pat. No. 2,652,219 to Arthur, U.S. Pat. No. 3,756,167 to Wilson and U.S. Pat. No. 4,323,016 to Flesher et al. Arthur and Wilson perpendicularly weld a layer of parallel rods across a sub-layer of parallel rods, while Flesher et al. shows intersecting square profile members. A problem with each of these is that the tops of the intersecting members used to create the grid or grate are not even, such that the upper surfaces of the members running in one direction are higher than the upper surfaces of the members running in the other direction. This creates a deck member with an upper surface likely to snag the objects placed thereon whenever the objects are slid across its surface. One solution to this problem is illustrated in U.S. Pat. No. 4,690,360 to Looker, where a thin sheet is affixed across the intersecting members, but this construction adds unnecessary weight to the pallet.

It is an object of this invention to provide a metal pallet construction where the deck member of the pallet is formed as a grid or grate by intersecting a plural number of parallel rod members perpendicularly with a plural number of parallel flat bar members positioned on edge such that an elongated thin edge of each flat bar member is its upper surface, where the upper surface of the deck member is flat and planar and the upper surfaces of the rod members are even with the upper surfaces of the flat bar members, in that the rod members are joined to the flat bar members by pressure resistance welding such that a portion of the thin edge of the flat bar member is melted and the rod member is pushed into the flat bar member to create a flush upper surface deck member in all directions.

SUMMARY OF THE INVENTION

The invention is a metal pallet, and its method of manufacture, for supporting relatively large loads a short distance above the ground or floor such that the pallet can be lifted and moved by a handtruck or fork lift, and comprises in general a deck member formed by perpendicularly intersecting a plural number of parallel rod members and a plural number of parallel flat bar members, where the flat bar members are positioned on edge such that one of the elongated thin edges defines the upper surface of the deck member in combination with the rod members, the rod and flat bar members forming a grate or grid enclosed by a peripheral framing edge member and preferably an outer frame member. Horizontally disposed skid members are connected to the deck member by skid uprights attached to the outer frame and interior uprights joined between adjacent flat bar members by a bridging member, to create a space to receive the tines of the handtruck or fork lift. The rod members are connected to the flat bar members using a pressure resistance welding technique, where the metal of the flat bar member is melted at the junction point and the bar member is pressed into the flat bar member such that the upper edge of the flat bar and the top of the round bar are flush and form a substantially flat and planar upper surface on the deck member in all directions.

DETAILED DESCRIPTION OF THE INVENTION

Figure 1:
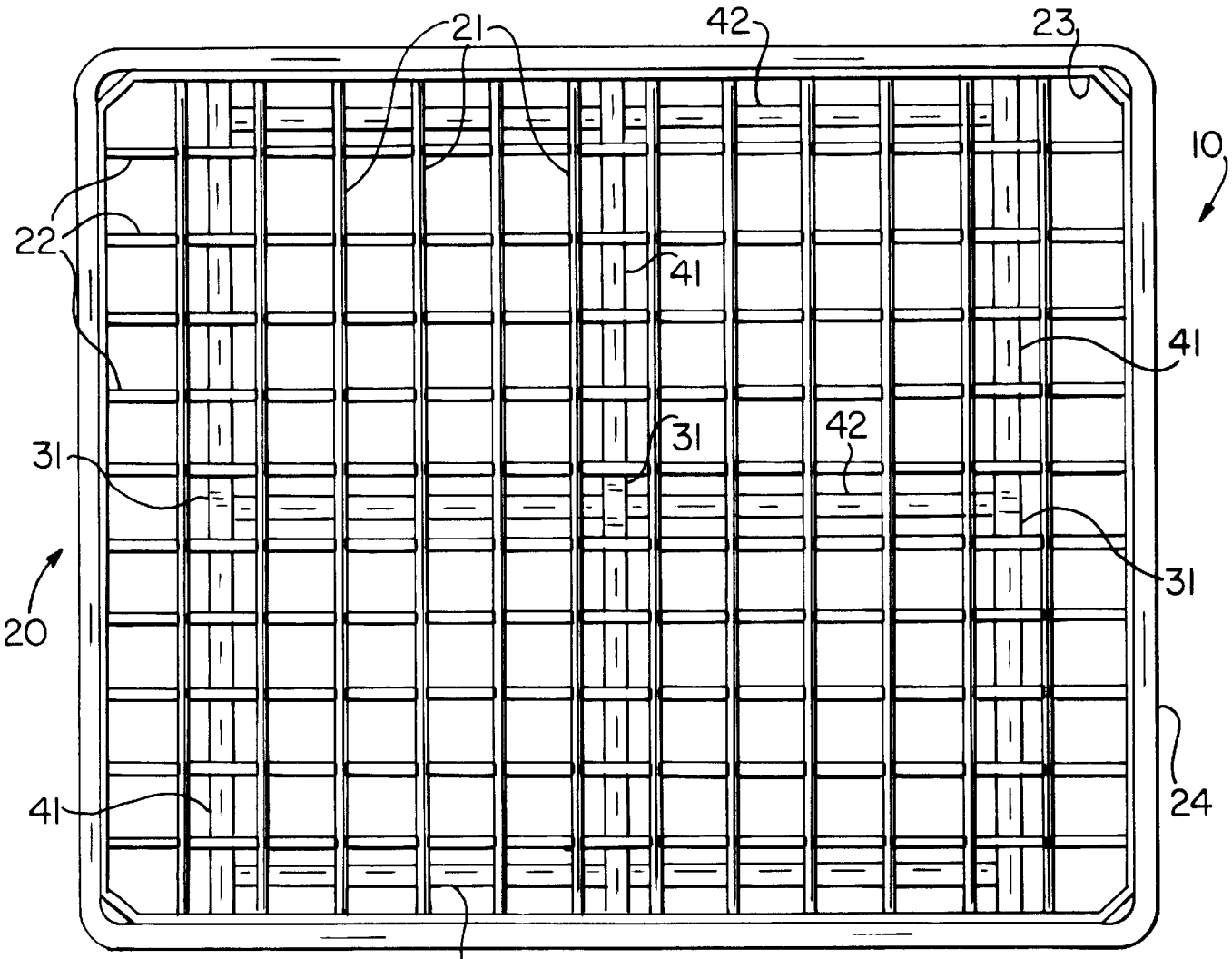
FIG. 1 is a top view of the invention.

With reference to the drawings, the invention will now be described in detail with regard for the best mode and the preferred embodiment. In general, the invention is a metal pallet 10, and its method of manufacture, for supporting a relatively large weight or large numbers of discrete items, where the pallet 10 includes a deck member 20 maintained sufficient distance from the floor or ground to allow for entry of the tines from a handtruck or forklift beneath the deck member 20 in order to lift and move the pallet 10. The pallet 10 is formed from a combination of aluminum, steel, stainless steel or similar metal components, preferably welded to create a strong and rigid finished product. Standard welding techniques may be used to join the majority of the components, but a platen welding technique is most preferably utilized to join the rod members 21 to the flat bar members 22 such that the rod members 21 are pressed into molten portions of the elongated thin edges 26 of the flat bar members 22 and the material allowed to harden in order to create a flat, planar upper surface 25 of the deck member 20.

Figure 3:
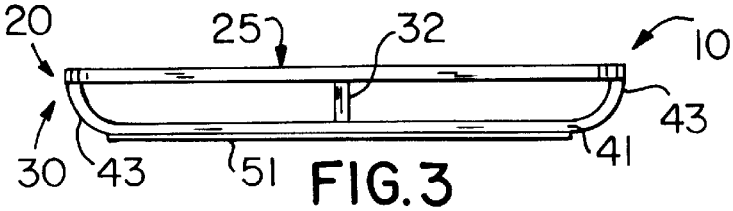
FIG. 3 is an end view of the invention.
Figure 2:
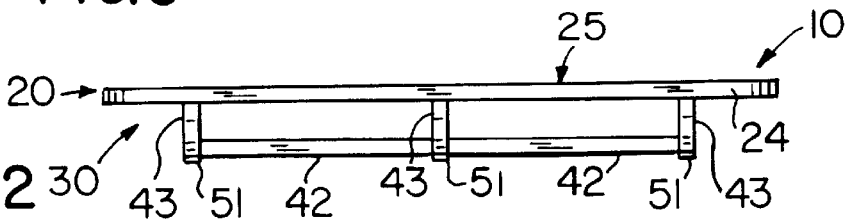
FIG. 2 is a side view of the invention.

As shown in FIGS. 1 through 3, the pallet 10 comprises in general a deck member 20 supported a short distance form the ground or floor in a horizontally disposed manner by support means 30 which comprise skid members 41, preferably three in number and positioned parallel to the deck member 20, connected to the deck member 20 by interior upright members 32 and skid upright members 43. Skid upright members 43 are preferably curved to preclude the pallets 10 from snagging when pushed along the ground or floor, and preferably each skid member 41 and its two skid upright members 43 are formed by bending a single piece of one-half to one inch square profile tubing. The skid upright members 43 are joined to the deck member 20 by welding or other suitable means, preferably being affixed to the framing edge member 23 or the outer frame member 24. The underside of skid members 41 may be provided with wear strip members 51, preferably composed of a thin flat bar material welded or adhesively affixed to the skid members 41. The wear strip members 51 are provided to prevent damage and wear to the skid members 41 themselves. Cross brace members 42, likewise composed of one-half to one inch square profile tubing are preferably perpendicularly attached between adjacent skid members 41 to maintain proper separation and alignment.

Figure 4:
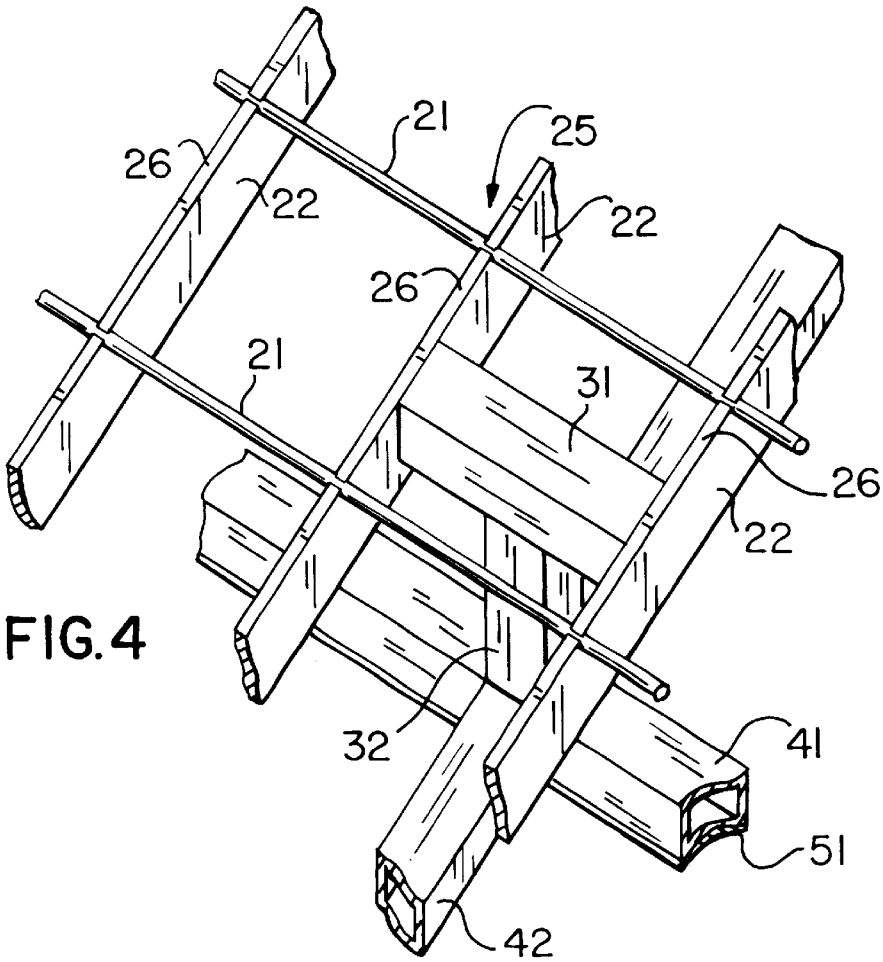
FIG. 4 is a perspective view of a portion of the invention showing the intersection of the rod and flat bar members, as well as an upright and bridging member.

The interior upright members 32 are preferably attached above the midpoint of each skid member 41 and each is connected to a horizontally disposed bridging member 31 to create a T-shaped combination, with the bridging member 31 connected to the deck member 20 by welding or other suitable fastener means between two adjacent flat bar members 22, as seen in FIG. 4. The interior upright and bridging members are also preferably composed of one-half to one inch square profile tubing. In order to sufficiently maximize the load capacity of the pallet 10, the interior upright members 32 and skid upright members 43 should be separated no farther than twenty four inches. Preferably the upper surface 25 of the deck member 20 is positioned approximately five inches above the ground or floor.

The deck member 20 comprises a plural number of wire or rod members 21 intersecting with a plural number of flat bar members 22, where each of the flat bar members 22 is positioned on edge with one of its elongated thin edges 26 being the top surface, as shown in FIG. 4. Preferably the rod members 21 are aligned in parallel to each other and the flat bar members 22 are aligned in parallel to each other, with the flat bar members 22 aligned perpendicularly to the rod members 21. The rod members 21 are preferably solid members, circular in cross-section with a diameter of about one-eighth inch, such that they are relatively rigid. The flat bar members 22 are preferably solid members, about one-half to one inch wide with a thickness of approximately 0.080 to 0.130 inches, such that they too are relatively rigid. Preferably the diameter of the rod members 21 is greater than the thickness of the flat bar members 22. The ends of rod members 21 and the ends of the flat bar members 22 are preferably connected to a rectangular framing edge member 23, which is preferably formed of one or more pieces of thin flat bar, bent at the corners and also positioned such that one of the elongated thin edges forms the top surface. Preferably, a rectangular outer frame member composed of one-half to one inch square profile tubing is attached to the outside of the framing edge member 23 to further strengthen the pallet 10, with the skid upright members 43 connected directly to the outer frame member 24.

Figure 5:
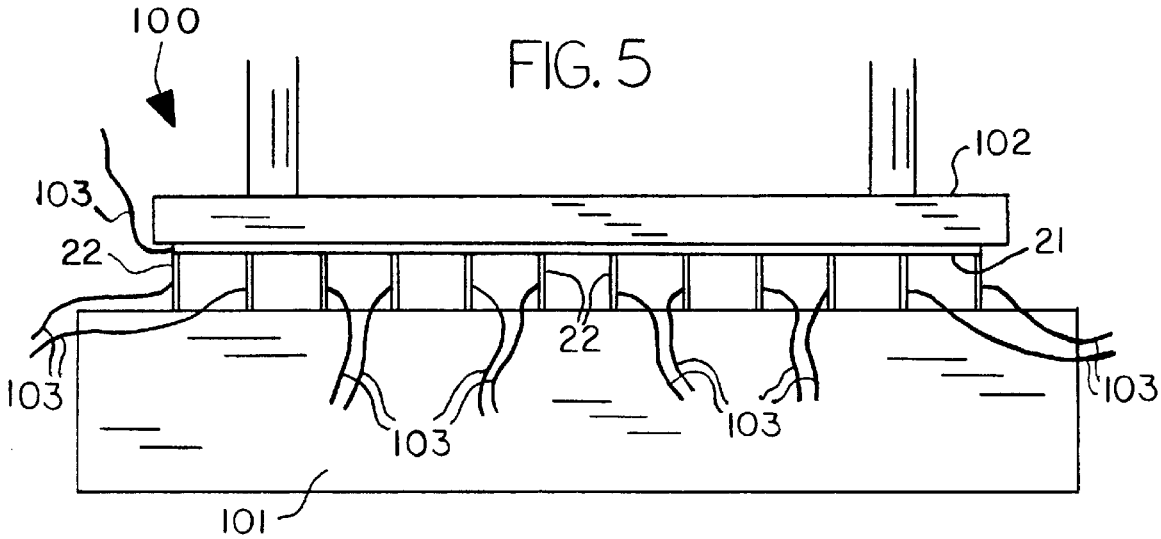
FIG. 5 is a side view of the pressure resistance welding apparatus with a rod member positioned atop the flat bar members prior to the application of electrical current and pressure.
Figure 6:
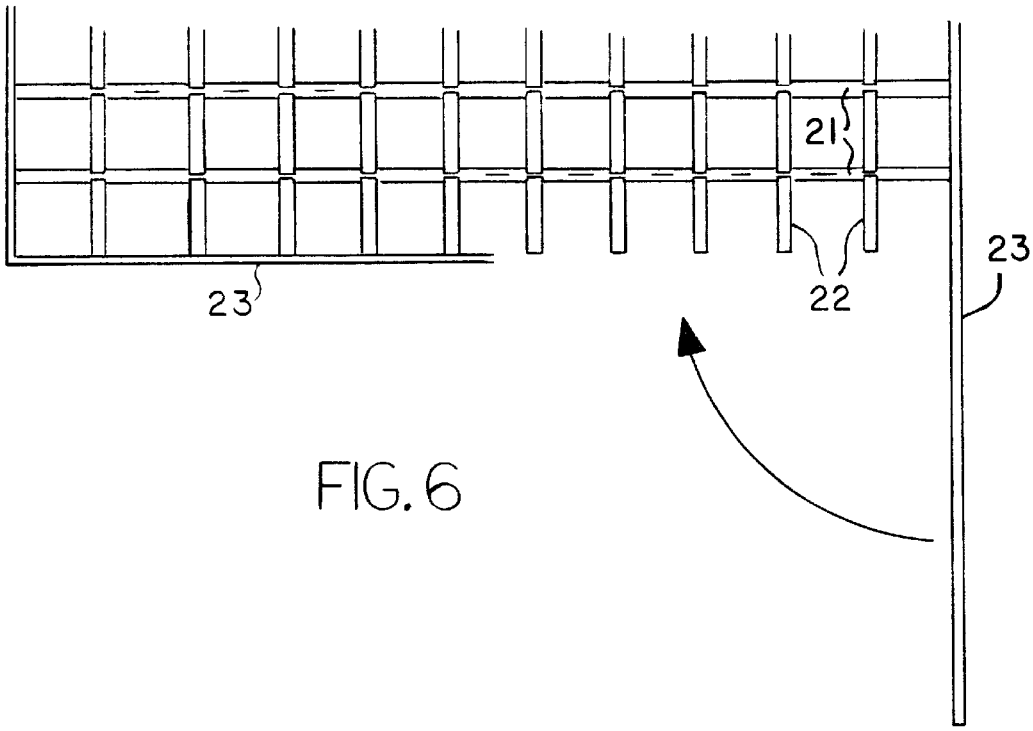
FIG. 6 is a partial top view of an alternative method for construction of the rod member, flat bar member and framing edge member assembly.

The pallet 10 is manufactured by properly positioning the flat bar members 22 in parallel manner spaced approximately four inches apart, with an elongated thin edge 26 of each flat bar member 22 facing upward. In a batch assembly process, two longer flat bar pieces are aligned on each side to form two sides of the framing edge member 23, with the extended portions then folded and welded to define the other two sides of the framing edge member 23, a shown in FIG. 6. Alternatively, the rod member 21 and flat bar member 22 grid assembly may be formed in a continuous production process, with the other components attached in subsequent individual steps. One or more of the rod members 21, as shown in FIG. 5, are then laid perpendicularly across the top of the elongated thin edges 26 of the flat bar members 22, likewise preferably spaced about four inches apart. A platen or pressure resistance welder 100, comprising a base 101, a press or platen 102, and means to apply electrical current, is then utilized to join the rod members 21 to the flat bar members 22 by the technique of pressure resistance welding. Electrical leads 103 are attached to the one or more rod members 21 and the flat bar members 22 beneath the intersection junctions, electrical current is applied simultaneously or step-wise as required in sufficient amount to cause melting of the flat bar members 22 at the intersections, and a platen 102 is pressed down on the rod members 21 from above. The metal material of the flat bar members 22 melts at the intersection contact junctions due to heat build-up from electrical resistance factors, such that the rod members 21 are pressed into the thin edge 26 of the flat bar members 22 to a distance such that the rod members 21 are embedded into the flat bar members 22 and the top of each of the rod members 21 is flush and even with the thin edge 26 of the flat bar members 22, as shown in FIG. 4. The molten metal encases the rod members 21 and is allowed to harden. This creates a deck member 20 with a flat, planar upper surface 25 in all horizontal directions, even though the deck member 20 is formed in a grid or grate pattern by the intersecting rod members 21 and flat bar members 22. To finish the pallet 10, the outer frame member 24 is formed and attached to the framing edge member 23, and the support means 30 is formed and joined to the deck member 20 by attaching bridging members 31 to adjacent flat bar members 22 and skid upright members 43 to the outer frame member 24.

The pallet 10 as described shows improved characteristics over other grate or grid pallets, in that the upper surface 25 of the deck member 20 is flat and even in all horizontal directions since the rod members 21 are embedded into the flat bar members 22 with the upper surface defined by the tops of the rod members 21 being even with the upper surface defined by the tops of the flat bar members 22, thus allowing items to be slid across the deck upper surface 25. The rod members 21 also prevent lateral folding or deflection of the flat bar members 22, and the combination of the rod members 21, flat bar members 22 and framing edge member 23 create a pallet 10 capable of supporting a concentrated load in excess of 4000 pounds with no deflection when constructed as set forth above, a capacity almost double that of typical wooden pallets now in use. The metal pallet 10 is much lighter than other metal pallets capable of supporting similar weight since the deck member 20 is formed as a grid or grate.

It is understood that equivalents and substitutions for certain elements described above may be obvious to those skilled in the art, and the true scope and definition of the invention therefore is to be as set forth in the following claims.

I claim:

1. A method of manufacture of a metal pallet comprising a deck member having a planar upper surface formed by the intersection of a plural number of rod members with a plural number of flat bar members, the flat bar members each having an elongated thin edge and positioned such that the elongated thin edge is the top surface of the flat bar members, where the rod members are embedded within the flat bar members such that the upper surface of the rod members are flush with the top surface of each of the elongated thin edges of the flat bar members in order to define the planar upper surface of the deck member, the method comprising the steps of:

providing a pressure resistance welding apparatus comprising a platen to apply pressure and a base to support a plural number of said flat bar members;

placing said flat bar members onto said base;

placing one or more said rod members across said top surface of each of said flat bar members;

attaching electrical leads to said flat bar members adjacent the intersections of said one or more rod members and said flat bar members;

applying current to said flat bar members in sufficient amount to cause melting of said flat bar members at said intersections;

moving said platen to apply pressure to said one or more rod members to force said rod members into the melted intersections of said flat bar members until said upper surface of said one or more rod members is flush with said top surface of each of said flat bar members.

2. The method of claim 1, where said flat bar members are placed in a parallel manner.

3. The method of claim 2, where said one or more rod members are placed perpendicular to said flat bar members.

4. The method of claim 1, where said one or more rod members are plural in number and are placed in a parallel manner.

5. The method of claim 1, further comprising the steps of providing framing edge members and placing said framing edge members to the outside of said flat bar members, such that said one or more rod members also contact said framing edge members.

6. The method of claim 5, further comprising the steps of providing an outer frame member and connecting said outer frame member to said framing edge member.

7. The method of claim 6, further comprising the steps of providing skid members and connecting said skid members to said outer frame member.

8. The method of claim 7, further comprising the steps of providing skid uprights, interior upright members and bridging members, connecting said bridging members to said interior upright members, connecting said skid uprights to said skid members and said outer frame member, and connecting said interior upright members and said bridging members to said skid members and to some of said flat bar members.

9. The method of claim 5, where said framing edge members are longer than said flat bar members, and further comprising the steps of bending and connecting said framing edge members to said flat bar members.

10. A method of forming a metal pallet comprising a deck member having a planar upper surface formed by the intersection of a plural number of rod members with a plural number of flat bar members, the flat bar members each having a top surface and an elongated thin edge and positioned such that the elongated thin edge defines the top surface of the flat bar members, where the rod members each have an upper surface and are embedded within the flat bar members such that the upper surface of the rod members are flush with the top surface of each of the elongated thin edges of the flat bar members in order to define the planar upper surface of the deck member, the method comprising the steps of arranging said flat bar members such that said elongated thin edges are the top surface, laying said rod members across said top surfaces in intersecting manner, attaching electrical leads to said flat bar members beneath the intersecting junctions of said rod members, and applying pressure against said rod members while simultaneously applying current through said electrical leads to melt the top surface of said flat bar members in order to press said rod members into said flat bar members to create a planar upper surface deck member.

11. The method of claim 10, further comprising the step of creating a framing edge member around said flat bar members.

12. The method of claim 11, further comprising attaching an outer frame member to said framing edge member, and attaching support means to said deck member.

* * * * *